US005163804A

United States Patent [19]

Kobayashi

[11] Patent Number: 5,163,804

[45] Date of Patent: Nov. 17, 1992

[54] ATTACHMENT FOR LOADING AND UNLOADING CONSTRUCTIONAL MATERIAL

[75] Inventor: Shoichi Kobayashi, Chiba, Japan

[73] Assignee: Kabushiki Kaisha SK, Chiba, Japan

[21] Appl. No.: 720,732

[22] Filed: Jun. 25, 1991

[30] Foreign Application Priority Data

Jun. 25, 1990 [JP] Japan ..... 2-67109

[51] Int. Cl.[5] ..... B66C 1/10

[52] U.S. Cl. ..... 414/739; 294/86.41; 294/88; 294/902; 294/99.1; 414/735

[58] Field of Search ..... 414/735, 739, 620, 621, 414/642; 294/86.41, 88, 902, 93, 99.1

[56] References Cited

U.S. PATENT DOCUMENTS

| | | | |
|---|---|---|---|
| 2,725,996 | 12/1955 | Britton | 414/739 X |
| 3,669,293 | 6/1972 | Bryan et al. | 414/704 |
| 4,002,245 | 1/1977 | Mink | 414/739 |
| 4,005,894 | 2/1977 | Tucek | 294/88 |
| 4,260,323 | 4/1981 | Muntjanoff | 414/739 X |
| 4,576,406 | 3/1986 | Johnson et al. | 294/86.41 |
| 4,707,013 | 11/1987 | Vranish et al. | 294/88 |

FOREIGN PATENT DOCUMENTS

| | | | |
|---|---|---|---|
| 1214510 | 2/1986 | U.S.S.R. | 414/739 |
| 1251325 | 10/1971 | United Kingdom | 294/88 |

*Primary Examiner*—Michael S. Huppert
*Assistant Examiner*—William M. Hienz
*Attorney, Agent, or Firm*—Oblon, Spivak, McClelland, Maier & Neustadt

[57] ABSTRACT

An attachment for loading and unloading a constructional material capable of substantially improving working efficiency and accomplishing labor saving. A pair of holding arm are pivotally mounted in a manner to be laterally spaced from each other on an arm mounting bracket arranged on a lower surface of a bracket mounted on an arm of a hydraulic shovel, between which a hydraulic cylinder is arranged, resulting in a constructional material being supported between or on the holding arms. Thus, force required for supporting the constructional material can be finely controlled as desired to prevent the material from being broken or damaged due to the application of excessive force thereto.

6 Claims, 7 Drawing Sheets

ATTACHMENT FOR LOADING AND UNLOADING CONSTRUCTIONAL MATERIAL

BACKGROUND OF THE INVENTION

This invention relates to an attachment for loading and unloading a constructional material, and more particularly to an attachment adapted to be mounted in a manner similar to a bucket on an arm of a vehicle having a hydraulic shovel used for construction work to load and unload a constructional material such as a concrete block, a U-shaped drainage conduit, a Hume pipe or the like.

Conventionally, work such as the arrangement and storage of the constructional material described above in a manufacturing factory, a construction site or a work site; the loading and unloading of the constructional material with respect to a truck; the heaping-up of the constructional material in a work site, or the like is generally manually carried out. This a because the weight of the constructional material is small to an extent that it can be manually transported, and a construction or work site generally fails to provide a work area sufficient to make mechanization of the work possible. However, the handling of the constructional materials which can be as many as ten to a hundred times a day not only is physically cruel but requires much time and labor, resulting in working efficiency being substantially deteriorated. Thus, labor saving and an improvement in working efficiency have been highly desirable.

Also, an attachment to a hydraulic shovel which has been conventionally used to load and unload a constructional material such as a concrete block is generally constructed in a manner like a fork claw. Unfortunately, the attachment a large force produced by a hydraulic cylinder of an arm of the hydraulic shovel to be transmitted directly to the constructional material through the attachment, resulting in the constructional material interposedly held by the attachment being broken or damaged, so that use of the attachment is substantially limited.

SUMMARY OF THE INVENTION

The present invention has been made in view of the foregoing disadvantage of the prior art.

Accordingly, it is an object of the present invention to provide an attachment for loading and unloading a constructional material which is capable of substantially improving working efficiency.

It is another object of the present invention to provide an attachment for loading and unloading a constructional material which is capable of accomplishing labor savings in the loading and unloading operation.

It is a further object of the present invention to provide an attachment for loading and unloading a constructional material which is capable of properly handling a constructional material.

It is still another object of the present invention to provide an attachment for loading and unloading a constructional material which is capable of effectively preventing the constructional material from being damaged or broken during the handling.

In accordance with the present invention, an attachment for loading and unloading a construction material is provided. The attachment includes an arm mounting bracket which is adapted to be arranged on a lower surface of a mounted bracket mounted on an arm of a hydraulic shovel. The arm mounting bracket has a pair of fixed shafts securely mounted thereon in a manner to be laterally spaced from each other. The attachment also includes a pair of holding arms, each of which is provided at a proximal end thereof with a proximal shaft and pivotally mounted through the proximal shaft on the fixed shaft of the arm mounting bracket, and a hydraulic cylinder connected between the holding arms through cylinder mounting shafts.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Figure 1:
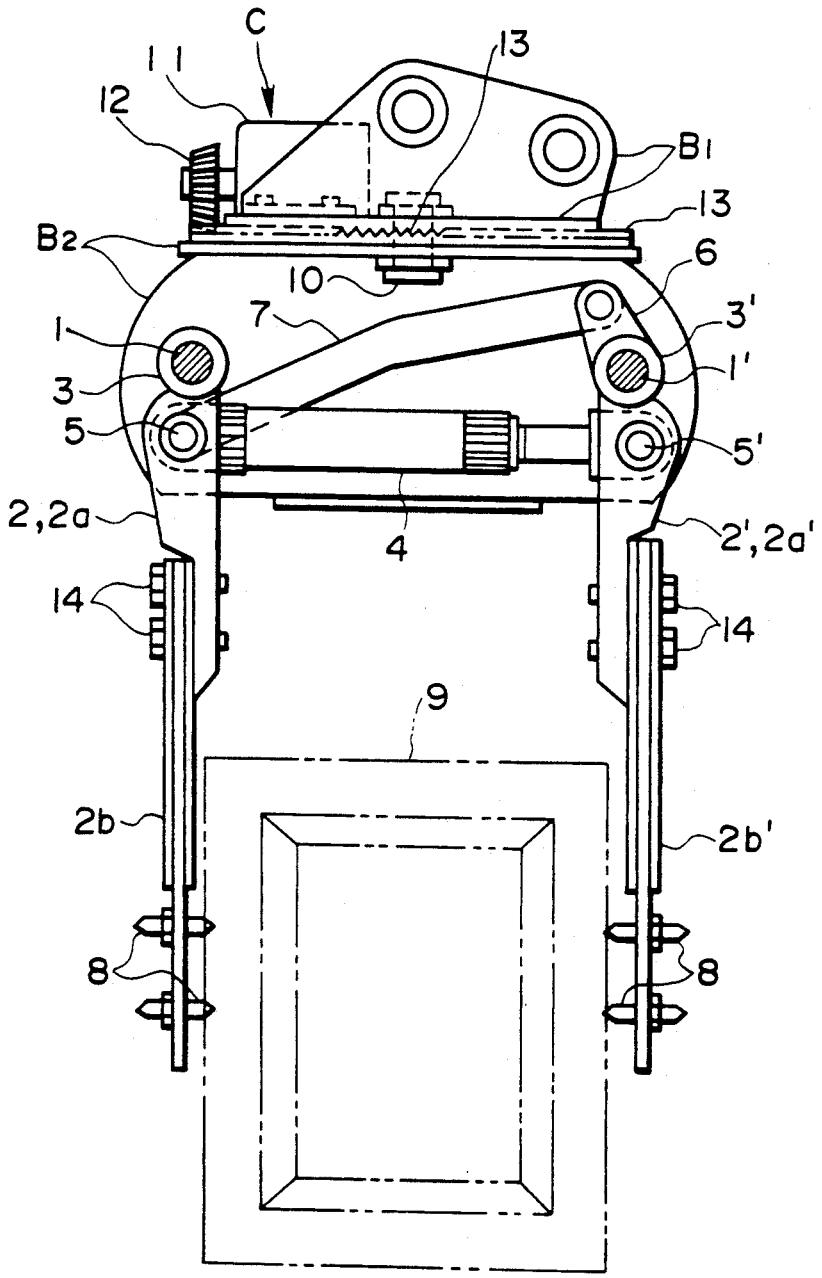
FIG. 1 is a fragmentary front elevation view taken along line a–a′ of FIG. 2 which shows an embodiment of an attachment for loading and unloading a constructional material according to the present invention.

Now, an attachment for loading and unloading a constructional material according to the present invention will be described hereinafter with reference to the accompanying drawings.

FIGS. 1 to 4, FIG. 5, and FIGS. 6A to 7C show embodiments of an attachment for loading and unloading a constructional material according to the present invention, respectively.

First, a general construction of an attachment of each of the illustrated embodiments will be described now.

The attachment of each of the illustrated embodiments includes a mounted bracket $B_1$ adapted to be mounted on an arm of a hydraulic shovel and an arm mounting bracket $B_2$ which has a pair of fixed shafts 1 and 1′ securely mounted thereon in a manner to be laterally spaced from each other and is arranged on a lower surface of the mounted bracket $B_1$. The arm mounting bracket $B_2$ includes a pair of holding arms 2 and 2' each provided at a proximal end thereof with a proximal shaft 3 (3') and pivotally mounted through the proximal shaft on the fixed shaft 1 (1') of the arm mounting bracket $B_2$. The attachment also includes a hydraulic cylinder 4 connected between both holding arms 2 and 2' through cylinder mounting shafts 5 and 5'. The proximal shaft of one of the holding arms 2 and 2' is provided with a short arm 6 in a manner to project therefrom. In the illustrated embodiment, the short arm 6 is provided on the proximal shaft 3' of the holding arm 2'. The attachment further includes a synchronous link 7 connected between the short arm 6 and the cylinder mounting shaft of the other of the holding arms 2 and 2'. In the illustrated embodiment, the link 7 is associated with the holding arm 2.

In each of the illustrated embodiments, the holding arms 2 and 2' each may be integrally formed of the same material. Alternatively, each of the holding arms 2 and 2' may be constructed so as to include a base section 2*a* (2*a'*) and a holding section 2*b* (2*b'*) which are formed separate from each other and connected to each other by means of at least one bolt 14. In the embodiment shown in FIGS. 1 to 4, the base section 2*a* (2*a'*) and holding section 2*b* (2*b'*) are connected through three such bolts 14; whereas, in the embodiment shown in FIG. 5, one such bolt 14 is used for this purpose. At least the holding section 2*b* (2*b'*) of each of the holding arms 2 and 2' is formed of at least one elastic material such as a leaf spring made of an elastic steel sheet or the like. In the embodiment shown in FIGS. 1 to 4, it is formed of three leaf springs. Also, each of the holding sections 2*b* and 2*b'* is formed on the inner surface or both inner and outer surfaces of the lower portion thereof with at least one non-slip projection 8. The projection 8 may be formed of a rigid material or a soft material. For example, the projection 8 employed in the embodiment shown in FIGS. 1 to 4 comprises a rigid bolt-like projection having a bit of a machine drill welded to the distal end thereof and threadedly mounted on each of the inner and outer surfaces of each holding section 2*b* (2*b'*), whereas the projection 8 employed in the embodiment shown in FIGS. 6A and 6B is a soft one which is formed of a rubber material into a cylindrical shape and fixed on each of the inner and outer surfaces of each holding section 2*b* (2*b'*) by means of a bolt.

Reference numerals 9, 15 and 16 designate a concrete block, a U-shaped drainage conduit and a Hume pipe, respectively, each of which is an example of the constructional material to be handled by the attachment of the present invention.

Further, in the attachment of the present invention, the arm mounting bracket $B_2$ is arranged on the lower surface of the mounted bracket $B_1$ in a manner to be horizontally rotatable about a connecting shaft 10, resulting in the angle of the bracket $B_2$ with respect to the bracket $B_1$ being adjustable.

For example, a bolt inserting hole (not shown) is formed at every 45 degrees on a circumferential line of the brackets $B_1$ and $B_2$ about the connecting shaft 10. Subsequently, the bracket $B_2$ is rotated by an angle to be adjusted with respect to the central line of the arm of the hydraulic shovel on which the bracket $B_1$ is integrally mounted and then a bolt is inserted into the bolt inserting hole followed by being fixed by means of a nut. This permits the bracket $B_2$ which constitutes a holding attachment to be rotatable with respect to the bracket $B_1$, resulting in the bracket being angularly adjustably rotatable or the angle of the bracket $B_2$ with respect to the bracket $B_1$ being adjustable.

In addition, a rotation unit or a bracket turning unit C may be provided so as to render the arm mounting bracket $B_2$ rotatable as described above, resulting in the angle of the bracket $B_2$ being rendered adjustable.

The bracket turning unit C may employ a servo motor or a hydraulic cylinder as a prime mover. Also, it may use a combination of a bevel gear and a spur gear, or a link mechanism. Preferably, the bracket turning unit C is so arranged that an operator for the hydraulic shovel may remotely control the bracket turning unit C to permit the arm mounting bracket $B_2$ to be rotated about the connecting shaft 10 by an angle to be adjusted.

In each of the illustrated embodiments, the bracket turning unit C comprises a prime mover 11 equipped with a bevel gear 12, which is then engaged with a spur gear 13 arranged on the upper surface of the bracket $B_2$, so that the adjustment of rotation of the bevel gear 12 by means of the prime mover 11 permits the arm mounting bracket $B_2$ or holding attachment to be angularly adjustably rotatable.

The foregoing description has been made in connection with the constructional material such as a concrete block or the like, however, an article to which the present invention is applied is not limited to such a constructional material as described above. The present invention is applicable to any article so long as it is held, transported, loaded and unloaded by the holding arms.

Also, the constructional material to be handled by the present invention may have various shapes and sizes other than those described above. In this instance, the configuration, material and number of holding arms, and the number of bolts and projections may be varied depending upon the shape and/or size of the constructional material to be handled.

Now, the manner of operation of the attachment of the present invention constructed as described above will be described hereinafter.

Figure 3:
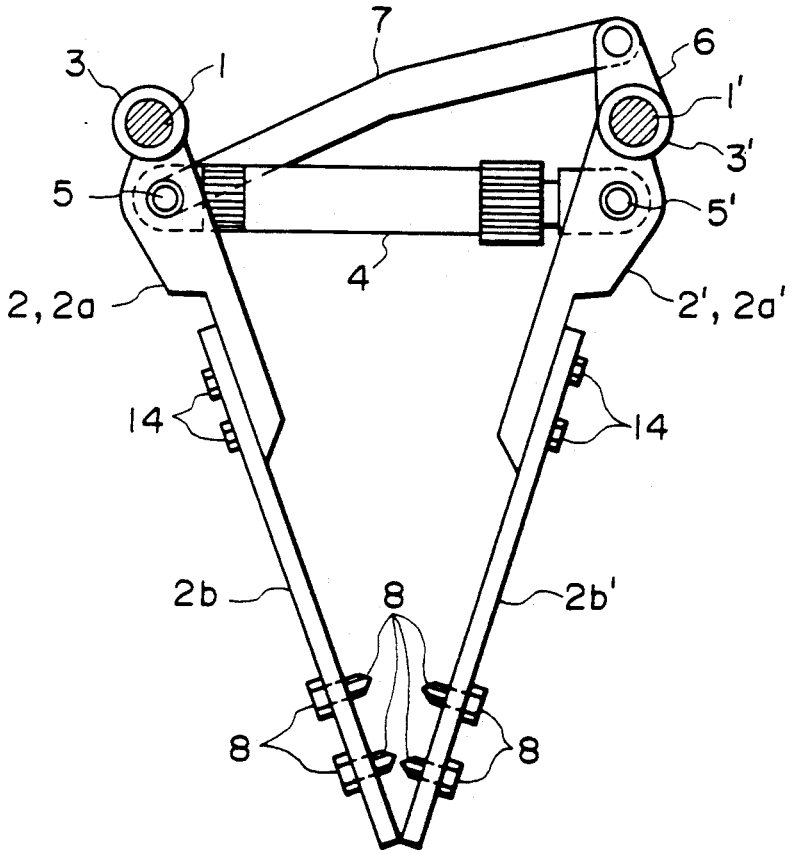
FIG. 3 is a schematic view showing a holding arm which is moved to a fully closed position.
Figure 4:
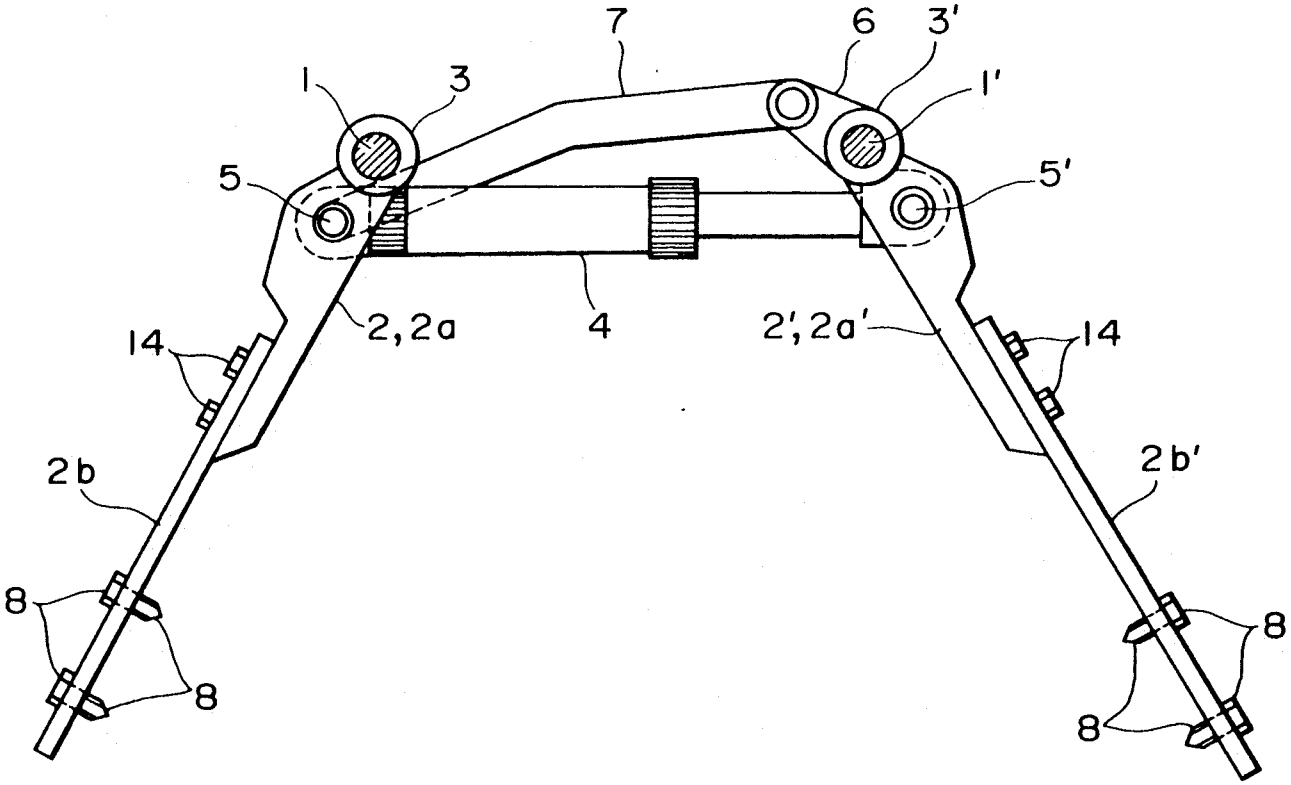
FIG. 4 is a schematic view of the holding arm shown in FIG. 3 which is moved to a fully open position.

The arm of the hydraulic shovel is operated to move the attachment of the present invention to a position above the constructional material such as the concrete block 9, U-shaped drainage conduit 15 or Hume pipe 16 and then a piston rod of the hydraulic cylinder 4 is extended to cause the holding arms 2 and 2' to be outwardly pivotally moved about the fixed shafts 1 and 1', resulting in the holding arms 2 and 2' being open. FIG. 4 shows the holding arms 2 and 2' which are moved to a fully open position. At this time, the short arm 6 projectedly provided at the proximal shaft 3' of the holding arm 2' is concurrently pivotally moved to force the cylinder mounting shaft 5 of the holding arm 2 through the synchronous link 7, to thereby cause the holding arms 2 and 2' to be open by the same angle in synchronism with each other. On the contrary, when the piston rod of the hydraulic cylinder 4 is contracted, the holding arms 2 and 2' are synchronously closed. FIG. 3 shows the holding arms 2 and 2' which are moved to a fully closed position.

The arm of the hydraulic shovel is lowered and the bracket turning unit C is actuated to position the concrete block 9 between the holding sections 2*b* and 2*b'* or insert the holding sections 2*b* and 2*b'* in a groove of the conduit 15 or Hume pipe 16 to fittedly support the conduit 15 or pipe 16 thereon.

Figure 2:
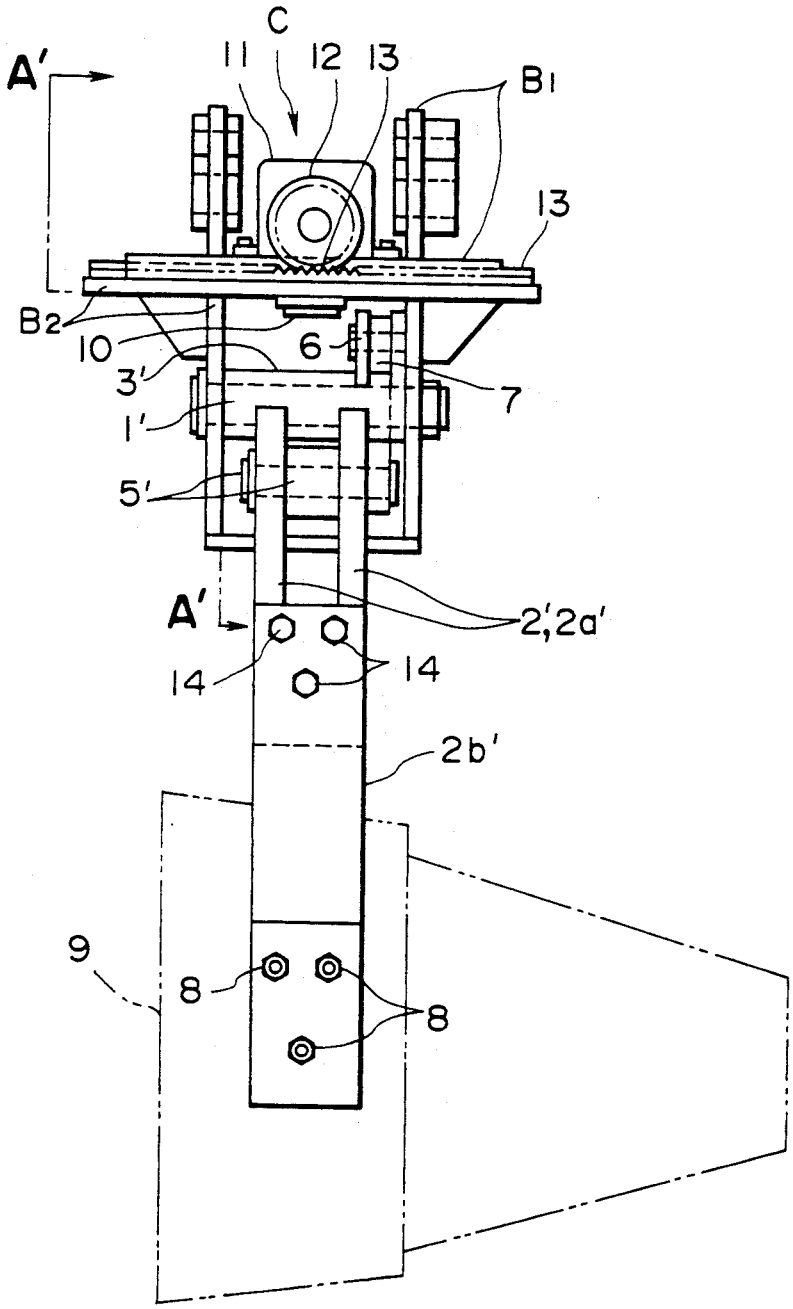
FIG. 2 is a side elevation view of the attachment shown in FIG. 1.

Then, the piston rod of the hydraulic cylinder 4 is contracted or extended to close or open the holding arms 2 and 2', to thereby interposedly support the block 9 therebetween or fittedly support the U-shaped drainage conduit 15 or Hume pipe 16 thereon. At this time, when the holding sections 2b and 2b' each include a plurality of the bolts 14 and a plurality of the projections 8 as shown in FIGS. 1, 2 and 7 wherein three such bolts and two or three such projections are arranged, the concrete block 9 is firmly interposedly supported between the holding sections and the conduit 15 or pipe 16 is firmly fittedly supported on the holding sections. Subsequently, the arm of the hydraulic shovel is operated or moved to a loading or unloading position or a working position while supporting the constructional material between or on the holding arms, and then the arm is further moved to cause the constructional material to be registered vertically and laterally. Thereafter, the bracket turning unit C is operated to direct the constructional material in a predetermined or desired direction and then the hydraulic cylinder 4 is extended or contracted again to open or close the holding arms 2 and 2', to thereby set the constructional material at a target position.

However, when the holding arms are hard to positionally accurately support the constructional material through the projections 8 for the reason that the constructional material is increased in weight or complicated in configuration or when the arm of the hydraulic shovel is operated to carry out handling of the constructional material at an elevated position or a lowered position, firm supporting of the constructional material by means of a plurality of the projections 8 causes excessive force to be applied to the constructional material, resulting in a possibility that the material is damaged or broken.

Figure 5:
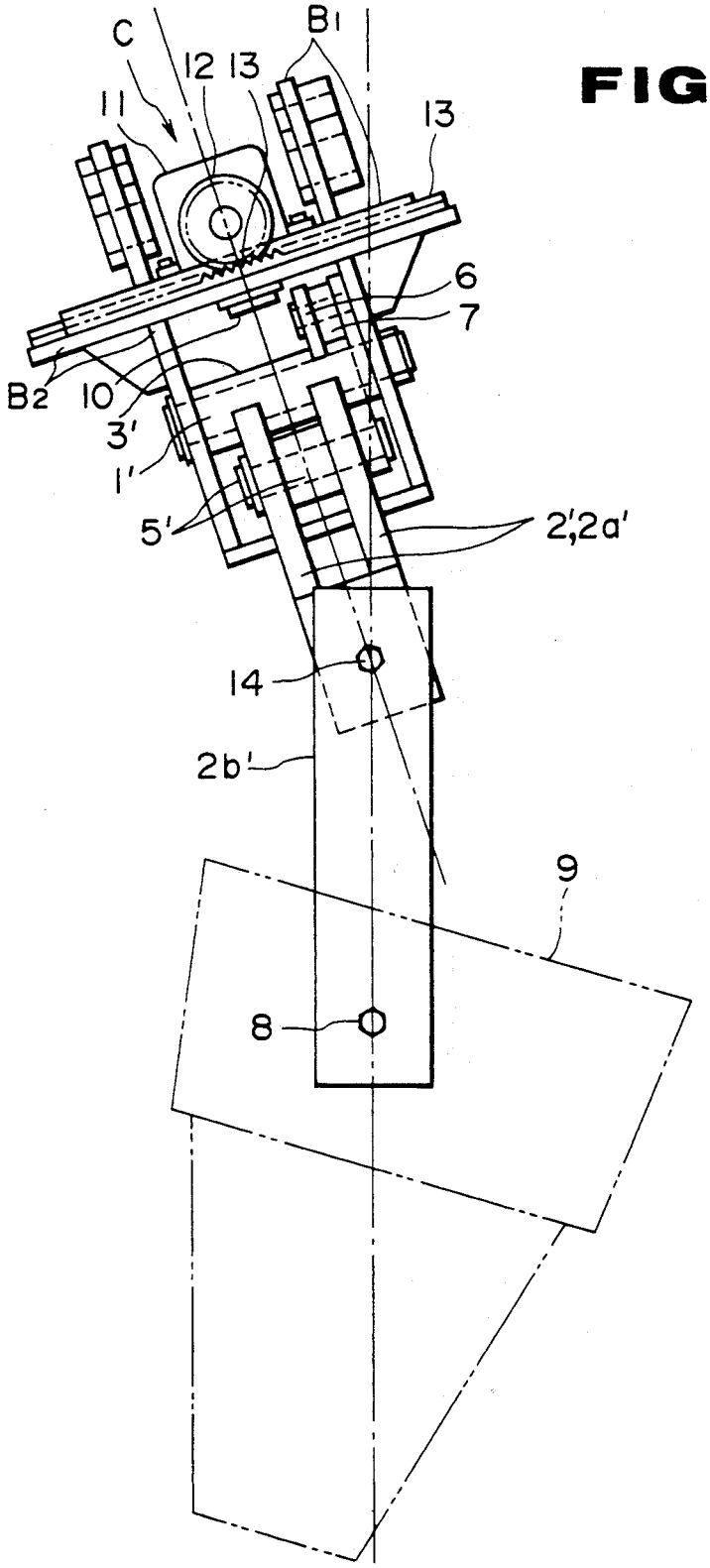
FIG. 5 is a side elevation view showing another embodiment of an attachment for loading and unloading a constructional material according to the present invention wherein each of holding sections includes one bolt and one projection.
Figure 6A:
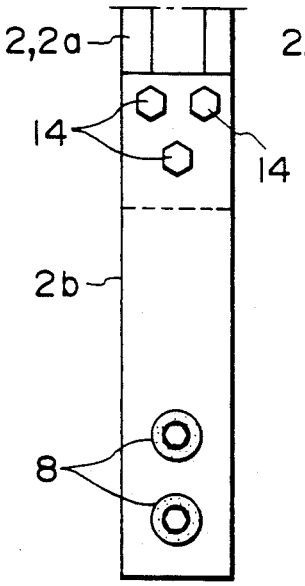
FIGS. 6A and 6B are a front elevation view and a side elevation view each showing holding sections employed in a further embodiment of an attachment for loading and unloading a constructional material according to the present invention, respectively, wherein each of the holding sections includes a projection formed of a soft rubber material into a cylindrical shape.
Figure 6B:
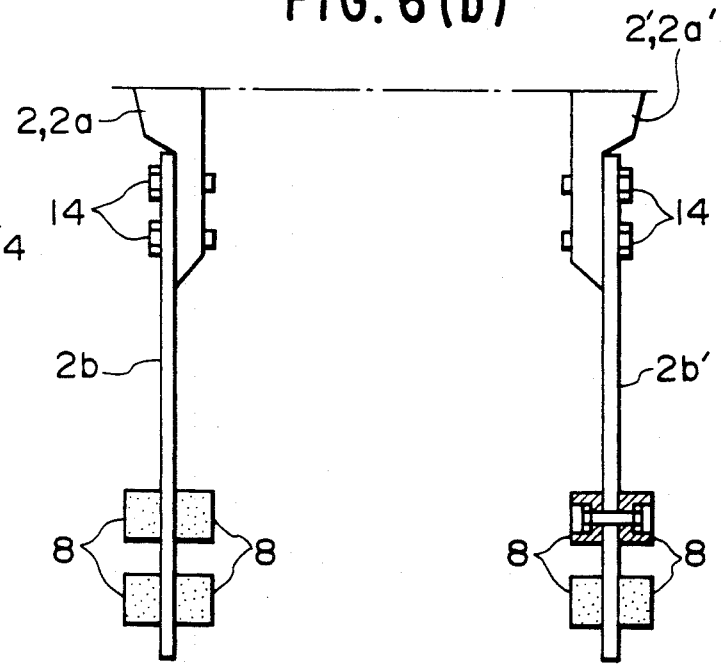
Figures 7A, 7B, 7C:
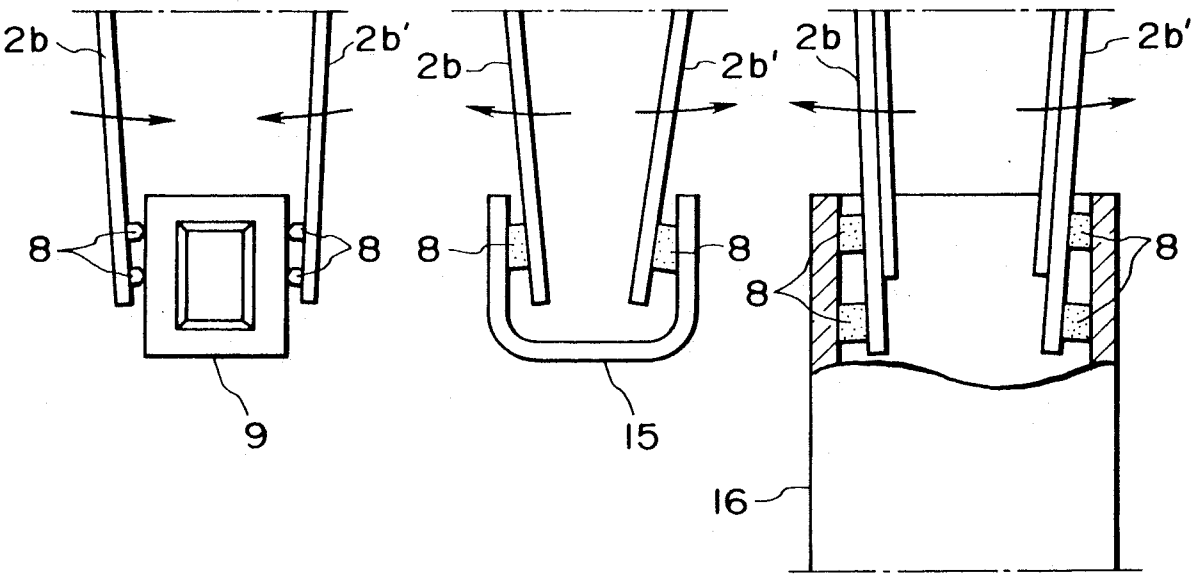
FIG. 7A is a schematic view showing holding sections having a concrete block interposedly held therebetween.
FIG. 7B is a schematic view showing holding sections having a U-shaped drainage conduit fittedly held thereon.
FIG. 7C is a schematic view showing holding sections having a Hume pipe fittedly held thereon.

In order to eliminate such a disadvantage, one such bolt 14 and/or one such projection 8 may be arranged on each of the holding sections 2b and 2b' as shown in FIG. 5. Such arrangement permits the holding sections 2b and 2b' to be spontaneously vertically oriented to take a natural posture while supporting the constructional material therebetween or thereon. Also, this permits the constructional material supported between or on the projections 8 to be spontaneously vertically orientated in the direction of the gravity. Thus, the constructional material can be smoothly handled while being permitted to take a natural posture.

As can be seen from the foregoing, the attachment of the present invention is so constructed that holding arms are pivotally mounted on the arm mounting bracket in a manner to be laterally spaced from each other, between which the hydraulic cylinder which is exclusively used for the attachment of the present invention and may be miniaturized is arranged, resulting in the constructional material being supported between or on the holding arms. Such construction permits force required for supportedly holding the constructional material between or on the holding arms to be finely controlled as desired, to thereby prevent the constructional material from being broken or damaged due to the application of excessive force thereto.

Also, in the present invention, at least the holding section of each of the holding arms is formed of at least one elastic material such as a leaf spring; therefore, even when excessive force is applied to the constructional material supported between or on the holding sections, the elastic holding sections positively exhibit a cushioning action sufficient to effectively prevent transmission of the constructional material directly to the constructional material as encountered in the use of rigid holding arms, so that the constructional material may be safely handled without being damaged or broken. Also, this permits the holding sections to be resiliently contacted with the constructional material, to thereby prevent the constructional material from slipping or being released from the attachment even when any external shock is applied thereto. Further, the number of leaf springs may be varied depending upon the weight of the constructional material to be handled, to thereby permit the attachment of the present invention to have a wide range of application.

Further, in the attachment of the present invention, the non-slip projection formed of a rigid or soft material may be arranged on each of the holding sections. Such arrangement significantly improves the supporting of the constructional material between or on the holding sections and contributes to stable handling of the constructional material through the holding sections. Arrangement of one bolt and/or one projection on each of the holding sections permits not only the holding sections to be spontaneously vertically oriented in the direction of gravity of the constructional material but the constructional material to be spontaneously vertically oriented in the direction of the gravity, so that the construction material may be smoothly and safely handled.

The arm mounting bracket $B_2$ constituting a part of the holding attachment of the present invention may be arranged in a manner to be angularly adjustably rotatable with respect to the mounted bracket $B_1$ through the bracket turning means. Such construction permits the arm of the hydraulic shovel and the hydraulic cylinder to move the attachment of the present invention in the vertical, lateral and transverse directions and vertically pivotally move the attachment by a desired angle along the central line of the arm. Also, this permits the attachment to be horizontally pivotally movable and angularly adjustable pivotable. Thus, the attachment of the present invention positionally adjusts the held constructional material as desired at a working place, to thereby substantially increase working efficiency and accomplish labor saving.

While the preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An attachment for loading and unloading a constructional material, comprising:

an arm mounting bracket arranged on a lower surface of a mounted bracket;

said arm mounting bracket comprising a pair of fixed shafts securely mounted thereon in a manner to be laterally spaced from each other;

a pair of holding arms each provided at a proximal end thereof with a proximal shaft on which each of said pair of holding arms are respectively mounted, each one of said pair of holding arms being pivotally mounted by way of its respective proximal shaft on a respective one of said pair of fixed shafts of said arm mounting bracket;

a hydraulic cylinder connected between said pair of holding arms by means of cylinder mounting shafts mounted on each of said pair of holding arms;

a short arm provided at said proximal shaft of one of said holding arms in a manner to project from said proximal shaft and said one holding arm; and a synchronous link connected between said short arm and said cylinder mounting shaft of the other of said holding arms;

wherein:

each of said pair of holding arms comprise first and second separate sections which are connected to each other by bolt means, one of said first and second sections of each of said pair of holding arms being a holding section for holding said constructional material, said holding section being formed of at least one elastic leaf spring and being provided on its inner surface portions with at least one non-slip projection, such that said elastic leaf spring and said non-slip projection permit said pair of holding arms to resiliently hold said constructional material.

2. An attachment as defined in claim 1, wherein said non-slip projection is made of a rigid material.

3. An attachment as defined in claim 1, wherein said non-slip projection is made of a soft material.

4. An attachment as defined in claim 1, wherein said arm mounting bracket is arranged in a manner to be horizontally rotatable about a connecting shaft and selectively fixed with respect to said mounted bracket by means of a bolt at a selected position.

5. An attachment as defined in claim 1, wherein said arm mounting bracket is arranged in a manner to be horizontally rotatable about a connecting shaft and angularly adjustable by means of a turning unit.

6. An attachment as defined in claim 5, wherein said turning unit comprises a prime mover mounted on said mounted bracket and equipped with a bevel gear and a spur gear arranged on said arm mounting bracket and engaged with said bevel gear, whereby said arm mounting bracket is rotatable through rotation of said bevel gear by remote control of said prime mover.

* * * * *